US010151052B2

(12) United States Patent
Massotte

(10) Patent No.: US 10,151,052 B2
(45) Date of Patent: Dec. 11, 2018

(54) YARN MANAGEMENT DEVICE

(71) Applicant: Superba S.A.S., Mulhouse (FR)

(72) Inventor: Philippe Massotte, Gueberschwihr (FR)

(73) Assignee: Superba S.A.S., Mulhouse (FR)

( * ) Notice: Subject to any disclaimer, the term of this patent is extended or adjusted under 35 U.S.C. 154(b) by 31 days.

(21) Appl. No.: 15/398,757

(22) Filed: Jan. 5, 2017

(65) Prior Publication Data

US 2017/0204539 A1 Jul. 20, 2017

(30) Foreign Application Priority Data

Jan. 14, 2016 (EP) ..... 16305031

(51) Int. Cl.

| | |
|---|---|
| ***D02G 1/02*** | (2006.01) |
| ***D02G 1/04*** | (2006.01) |
| ***D02G 1/12*** | (2006.01) |
| ***D02G 1/08*** | (2006.01) |
| ***D02G 1/20*** | (2006.01) |

(52) U.S. Cl.

CPC ..... *D02G 1/0266* (2013.01); *D02G 1/02* (2013.01); *D02G 1/04* (2013.01); *D02G 1/08* (2013.01); *D02G 1/12* (2013.01); *D02G 1/205* (2013.01)

(58) Field of Classification Search

CPC ..... D02G 1/02; D02G 1/08; D02G 1/0266; D02G 1/04; D02G 1/12; D02G 1/205

See application file for complete search history.

(56) References Cited

U.S. PATENT DOCUMENTS

| | | | | |
|---|---|---|---|---|
| 2,089,199 A | | 8/1937 | Finlayson et al. | |
| 2,863,277 A | * | 12/1958 | Philippe Boillat | D02G 1/06 384/100 |
| 2,936,567 A | | 5/1960 | Russell et al. | |
| 3,070,869 A | * | 1/1963 | Shaw James L | D02G 1/12 28/266 |
| 3,461,521 A | * | 8/1969 | Eskridge Brewster B | D02G 1/12 264/235 |
| 3,686,845 A | * | 8/1972 | Okada | D02G 1/0233 57/290 |

(Continued)

FOREIGN PATENT DOCUMENTS

| | | |
|---|---|---|
| GB | 1164612 | 9/1969 |
| JP | S46-006278 Y1 | 3/1971 |

(Continued)

OTHER PUBLICATIONS

Europe Patent Application No. 16305031.3, Search Report dated Sep. 19, 2016.

*Primary Examiner* — Ismael Izaguirre
(74) *Attorney, Agent, or Firm* — Kilpatrick Townsend & Stockton LLP

(57) ABSTRACT

Disclosed is a yarn management device in a yarn treatment line downstream of a crimping box and upstream of a thermofixing means for crimping, said device including a fixed support and at least one axial drum positioned upstream of the thermofixing means. In some cases, the inlet of the crimping box is formed by one or more crimping rollers for feeding at least one yarn into the crimping box. The drum is traversed by a yarn in the crimping box and mounted on the fixed support of the device so as to perform a substantially axial rotation, allowing the generation of at least one false twist on the treated yarns.

11 Claims, 3 Drawing Sheets

(56) References Cited

U.S. PATENT DOCUMENTS

| | | | | | |
|---|---|---|---|---|---|
| 3,745,755 | A * | 7/1973 | Keto | D02G 1/08 | 57/342 |
| 3,934,398 | A * | 1/1976 | Shindo | D02G 1/06 | 57/346 |
| 6,385,827 | B1 * | 5/2002 | Stewart | D02G 1/122 | 28/263 |

FOREIGN PATENT DOCUMENTS

| | | | | |
|---|---|---|---|---|
| JP | S50142828 | A | | 11/1975 |
| JP | 59106526 | A | * | 6/1984 |

* cited by examiner 4
4b
6
4c
6a
S

YARN MANAGEMENT DEVICE

CROSS REFERENCE TO RELATED APPLICATION

The present application claims priority benefit of Europe Patent Application No. 16305031.3 filed Jan. 14, 2016, the content of which is incorporated herein by reference in its entirety.

FIELD OF THE INVENTION

The present invention relates to the field of yarn management mechanisms in a processing system and, more particularly, to the field of yarn management mechanisms upstream of a thermal processing interface.

BACKGROUND

At the present time, when a plurality of yarns is treated together, all the yarns treated, coming from several coils, are combined to form a strand.

However, due to the various processing operations carried out on this strand of yarns treated simultaneously, it has been observed that, for the same treated strand, certain yarns exhibit quality deviations, raising a problem in the homogeneity of the yarn processing by the device.

SUMMARY

The object of the present invention is to alleviate these drawbacks by proposing a solution which makes it possible to eliminate this problem of homogeneity between the various treated yarns.

The object of the invention is thus a device for managing yarns in a yarn processing line downstream of a crimping box and upstream of a thermofixing means for crimping, said device comprising a fixed support, the inlet of the crimping box being formed by one or more crimp rollers for feeding at least one yarn into the crimping box, characterized in that the device comprises at least one axial drum positioned upstream of the thermofixing means, the drum being traversed by a yarn in the crimping box and mounted on the fixed support of the device so as to perform a substantially axial rotation to generate at least one false twist on the treated yarns.

The invention also relates to a drum, characterized in that it comprises:

- a substantially axial and tubular body comprising, on the one hand, an outer surface and, on the other hand, an inner surface, as well as at least one opening at each of its ends, these openings being able to allow the passage of at least one yarn,
- at least one interface for mounting the body of the drum on a frame allowing rotation of the body of the drum about an axis,
- at least one gripping surface of at least one yarn, disposed on the inner surface of the body of the drum and capable of allowing the rotation of at least one yarn with the body of the drum.

The invention also relates to a method for managing yarns in a yarn processing line, characterized in that it comprises a step of generating at least one false twist of the yarns during the passage of the yarns in a drum, prior to a step of thermofixing of the yarns.

BRIEF DESCRIPTION OF THE DRAWINGS

The invention will be better understood from the description that follows, which relates to a non-limiting example and explained with reference to the accompanying diagrammatic drawings, in which.

DETAILED DESCRIPTION

Figure 1:
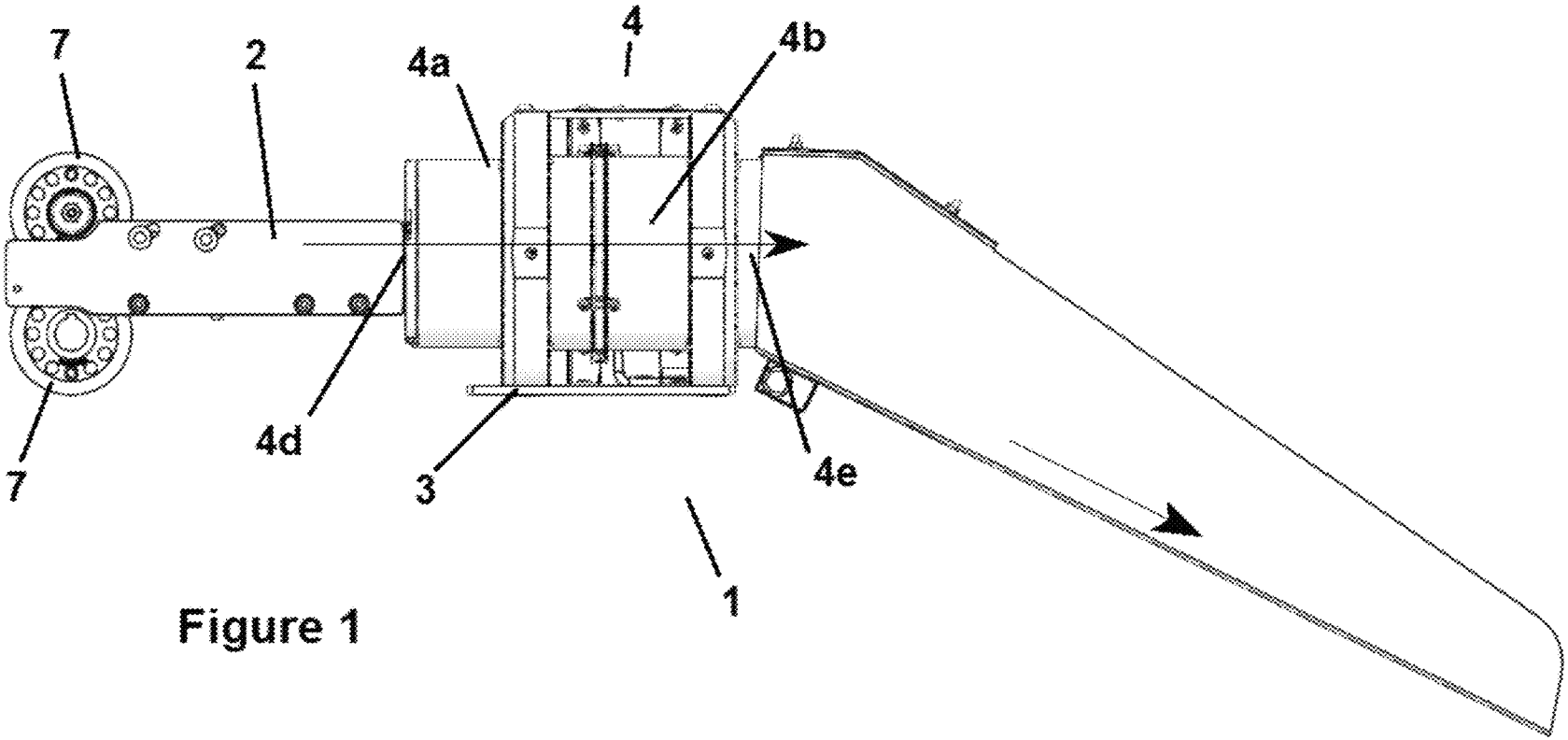
FIG. 1 is a schematic representation of an example of a yarn management device according to the invention, in which the arrows indicate the direction of movement of the yarns.

The present invention relates to a device for managing yarns in a yarn processing line downstream of a crimping box 2 and upstream of a thermofixing means for the crimping, said device 1 comprising a fixed support 3, the inlet of the crimping box 2 being formed by one or more crimping rollers 7 for feeding at least one yarn into the crimping box 2, characterized in that the device 1 comprises at least one axial drum 4 positioned upstream of the thermofixing means, the drum 4 being traversed by a yarn in the crimping box 2 and mounted on the fixed support 3 of the device 1 so as to perform a substantially axial rotation for generating at least one false twist to the treated yarns.

The generation of a false twist on all the yarns intended to undergo a thermal treatment allows homogenizing the distribution of these yarns when they are placed in the thermofixing means.

During their passage through the axial drum 4, the yarns are without tension. The tilting by rotation of the drum 4 allows modifying the distribution of the portion of the yarns present in the drum within the strand of yarns which unites them. This modification of the distribution of the yarns by the drum 4 in the treatment line thus allows reorganizing the yarns within the strand over the whole of their respective length. Similarly, the generation of this false twist allows different portions of the same yarn to be arranged differently along the treatment line, for example on the conveyor belt, and in particular at each of the stages of treatment of the yarn with the other yarns of the strand.

Thus, the invention also relates to a method for managing yarns in a yarn treatment line, characterized in that it comprises a step of generating at least one false twist of the yarns during the passage of the yarns in a drum, prior to a step of thermofixing of the yarns.

Figure 2:
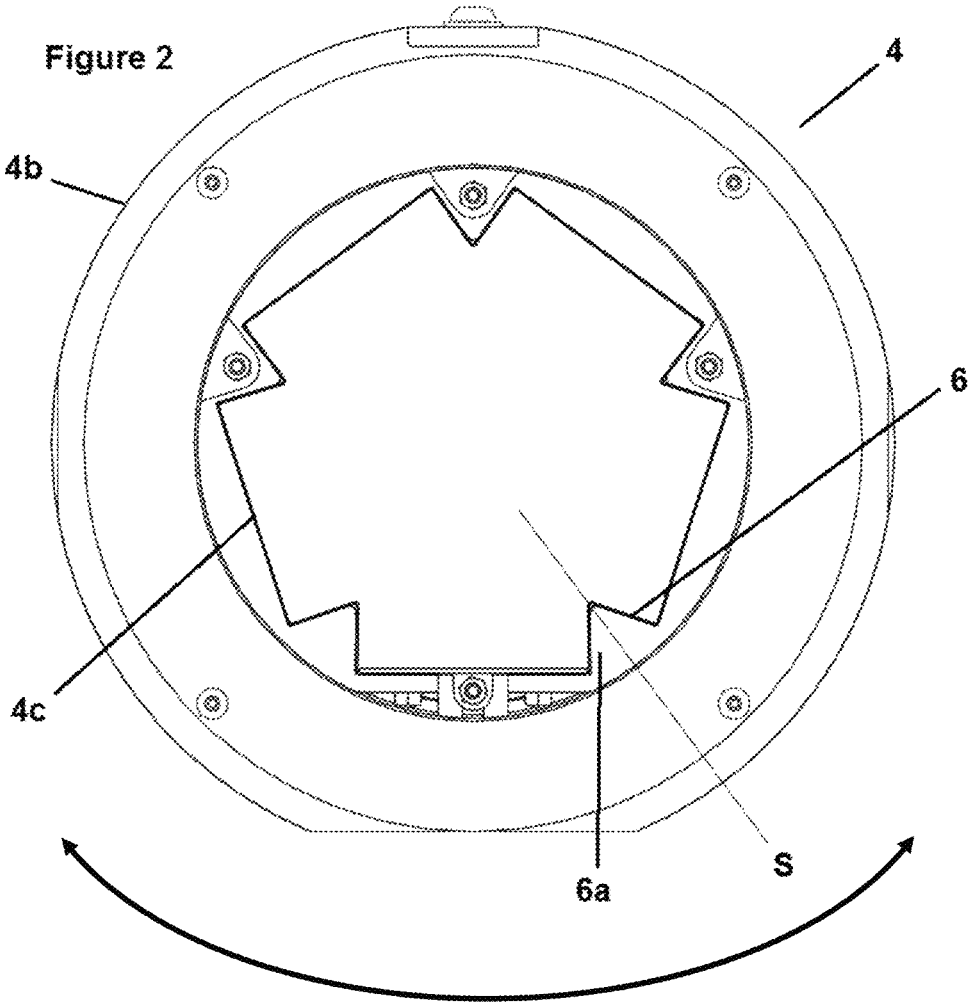
FIG. 2 is a schematic representation of a first example of a drum according to the invention.
Figure 3:
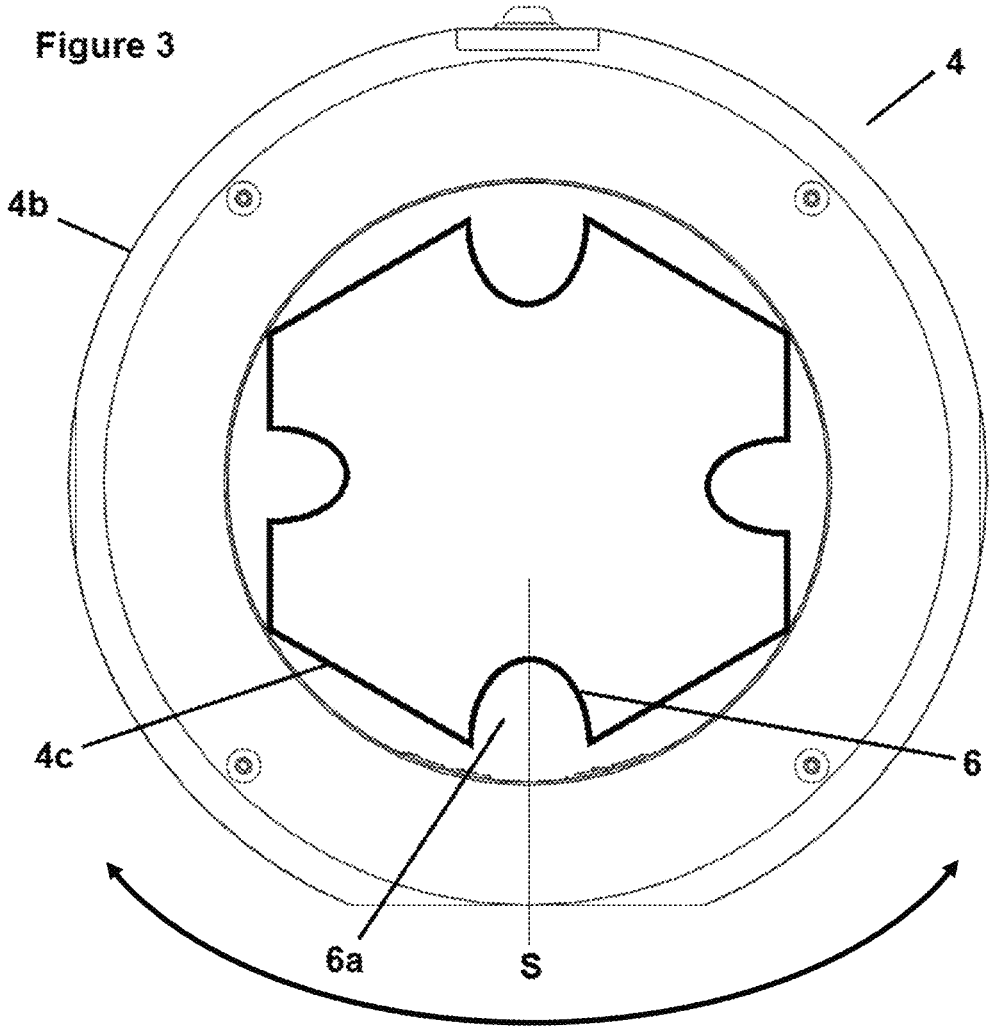
FIG. 3 is a schematic representation of a second example of a drum according to the invention.

An anarchic rotation of the drum 4 would lead to a similar result in the homogenization of the treatment of the yarns within the strand. However, the generation of a false twist by the drum 4 has additional advantages in that, on the one hand, it avoids the entanglement of the various yarns of a same strand and, on the other hand, allows easy disentangling during the winding operation at the end of the treatment. According to one particular feature of construction, the yarn management device 1 according to the invention is characterized in that the drum 4 is mounted on the fixed support 3 of the device 1 and arranged to perform a pendular rotary movement, represented by the arrows in FIGS. 2 and 3, about the axis of the drum 4.

According to an example construction of the management device 1 of the invention, the drum 4 is associated with a driving means for driving in rotation. This association can be achieved by any known mechanism, for example a drive belt or a gear.

According to a construction feature of the complementary device, the axis of rotation of the drum 4 is oriented along a substantially horizontal axis. According to this construction, the movement of the yarns through the drum 4 is generated either upstream by the arrival of the yarns through the supply rack which performs a stuffing in the drum 4 as it undergoes a pendular tilt, or downstream by traction of the yarns deposited on a drive means, for example a conveyor belt, or a combination of these two events.

It should be noted that the pendular tilt of the drum 4 allows limiting, or even eliminating, the tensions on the yarns when these are pulled by the drive means downstream of the drum 4.

According to a construction alternative to this feature, the axis of rotation of the drum 4 is oriented along an axis inclined with respect to a horizontal axis. Preferably, this inclination is achieved from a high point upstream of the drum 4 to a low point downstream of the drum 4. Such an inclination allows facilitating the movement of the yarns through the drum 4 from a high point to a low point, taking advantage of the gravity of the yarns which constitute the strand passing through the drum 4.

The invention also relates more specifically to the drum 4 adapted to allow the generation of a false twist on the various yarns which pass through it.

The drum 4 according to the invention is thus characterized in that it comprises:

- a substantially axial and tubular body 4*a* comprising, on the one hand, an outer surface 4*b* and, on the other hand, an inner surface 4*c*, as well as at least one opening 4*d*, 4*e* at each of its ends, these openings 4*d*, 4*e* being able to allow the passage of at least one yarn,
- at least one interface for mounting the body of the drum 4 on a frame 3 allowing rotation of the body 4*a* of the drum 4 about an axis, and
- at least one gripping surface 6 of at least one yarn disposed on the inner surface 4*c* of the body 4*a* of the drum 4 and capable of enabling the rotation of at least one yarn with the body 4*a* of the drum 4.

According to one example, the drum 4 of the invention has a body 4*a* of substantially cylindrical shape with a circular or oval cross-section. However, this shape could have a polygonal cross section, for example pentagonal, hexagonal or octagonal.

Alternatively or in addition, the drum 4 of the invention is characterized in that the inner surface 4*c* of the body 4*a* of the drum 4 has a substantially conical shape. The conical arrangement is preferably disposed from a restricted upstream opening to a wide downstream opening. Such an arrangement allows performing an easy installation at the outlet of the drum 4, for example at a precise point of a drive means such as a conveyor belt.

According to one particular construction feature, the body 4*a* of the drum 4 has a substantially axial tubular shape. However, this axis of the body 4*a* of the drum 4 may be different from the axis of rotation of the drum 4 during its operation for the generation of false twists. However, according to one example, the axis of rotation of the drum 4 coincides with the axis of the body 4*a* of the drum 4.

According to one particular construction feature, the drum 4 comprises at least one gripping surface 6 achieved by at least one relief on the inner surface in a section perpendicular to the axis of the drum 4. This gripping surface 6 participates in the rotating drive of the yarns in order to generate false twists therein in conjunction with the rotation of the drum 4. In addition to the rotating drive, this gripping surface 6 must nevertheless let the yarns slide through the body 4*a* of the drum 4.

Preferably, this gripping surface 6 is made continuously over the length of the inner surface 4*c* of the drum 4 between the upstream opening 4*d* and the downstream opening 4*e*. This gripping surface 6 can also be continuous or discontinuous along the periphery of the inner surface 4*c* of the drum 4.

According to a first non-limiting construction feature of the invention, this gripping surface 6 is produced by a rough surface, for example of the emery cloth type deposited over all or part of the inner surface 4*c* of the body 4*a* of the drum 4.

According to another construction feature, possibly complementary to the preceding feature, the drum 4 is characterized in that it comprises at least one gripping surface 6 made by at least one relief 6*a* of the inner surface 4*c*. This relief 6*a*, which forms an overhang with respect to the inner surface 4*c*, allows rotating the various yarns with the drum 4 at the portion of yarns which passes through this drum 4. This relief 6*a* may be specific to a drive in rotation of the yarns according to a particular direction of rotation of the drum 4.

According to an exemplary construction of this feature, the relief 6*a* which forms this gripping surface 6 in the drum 4 is disposed so as to provide a continuous relief 6*a* along the length of the inner surface 4*c* of the drum 4 between the upstream opening 4*d* and the downstream opening 4*e*. Alternatively, the relief 6*a* is constructed so as to have a variation in its height between a greater height at a point near the upstream opening 4*d* and a smaller height at a point near the downstream opening 4*e*.

However, according to a specificity of this construction feature, the relief 6*a* comprising an axis of symmetry S which intersects the axis of rotation of the drum 4 in a section perpendicular to the axis of the structure of the drum 4. The realization of a relief 6*a* comprising such symmetry allows operating a rotation drive of the different yarns by the drum 4 that is identical in both directions of rotation of the drum 4. Such a construction facilitates the generation of false homogeneous twists at the various threads moving through the drum 4.

According to a construction feature of the drum 4, the inner surface 4*c* of the body 4*a* of the drum 4 comprises at least two gripping surfaces 6 of at least one yarn. The multiplication of the number of gripping surfaces 6 of the yarn inside the drum 4 allows optimizing the rotation drive of the yarns with the tilt of the drum 4.

According to an example, the drum 4 of the invention is adapted to be integrated into a yarn management device 1 according to the invention.

Of course, the invention is not limited to the embodiment described and shown in the accompanying drawings. Modifications remain possible, in particular from the point of view of the constitution of the various elements or by substitution of technical equivalents, without thereby departing from the scope of protection of the invention.

The invention claimed is:

1. A device for managing yarns in a yarn treatment line downstream of a crimping box, said device comprising:

- a fixed support, and
- at least one axial drum positioned downstream of the crimping box, wherein:

an inlet of the crimping box is formed by one or more crimping rollers for feeding at least one yarn into the crimping box, the drum is traversed by the at least one yarn in the crimping box and mounted on the fixed support of the device so as to perform a substantially axial rotation for generating at least one false twist to the at least one yarn, and the drum is mounted on the fixed support of the device and arranged to perform a pendular rotary movement around an axis of the drum.

2. The device according to claim 1, wherein the axis of rotation of the drum is oriented along a substantially horizontal axis.

3. A drum comprising:

a substantially axial and tubular body comprising an outer surface and an inner surface and at least one opening at each of its ends, these openings allowing passage of at least one yarn, at least one interface for mounting the tubular body of the drum on a frame allowing the tubular body of the drum to be rotated in a pendular rotary movement about an axis of the drum, and at least one gripping surface disposed on the inner surface of the tubular body of the drum and capable of rotating the at least one yarn with the tubular body of the drum.

4. The drum according to claim 3, wherein the at least one gripping surface is formed by at least one relief of the inner surface in a section perpendicular to the axis of the drum.

5. The drum according to claim 3, wherein the at least one gripping surface is formed by at least one relief of the inner surface.

6. The drum according to claim 3, wherein the at least one gripping surface comprises at least two gripping surfaces disposed on the inner surface of the tubular body.

7. The drum according to claim 3, wherein the axis of the drum coincides with an axis of the drum tubular body.

8. The drum according to claim 3, wherein the inner surface of the drum has a substantially cylindrical shape.

9. The drum according to claim 3, wherein the drum is adapted to be integrated into a yarn management device.

10. A method for managing yarns in a yarn treatment line, comprising a step of generating at least one false twist of the yarns during passage of the yarns in a drum, wherein the drum is mounted on a fixed support and arranged to perform a pendular rotary movement around an axis of the drum.

11. The yarn management method according to claim 10, wherein the method is implemented in a yarn management device.

* * * * *